US011756749B2

(12) United States Patent
Bruchschmidt et al.

(10) Patent No.: US 11,756,749 B2
(45) Date of Patent: Sep. 12, 2023

(54) PUSH-BUTTON SWITCH ASSEMBLY WITH IDENTIFICATION OF SWITCHING STATES

(71) Applicant: Eaton Intelligent Power Limited, Dublin (IE)

(72) Inventors: Frank Bruchschmidt, Dausenau (DE); Petra Ries, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 92 days.

(21) Appl. No.: 17/423,113

(22) PCT Filed: Jan. 13, 2020

(86) PCT No.: PCT/EP2020/050652
§ 371 (c)(1),
(2) Date: Oct. 19, 2021

(87) PCT Pub. No.: WO2020/148210
PCT Pub. Date: Jul. 23, 2020

(65) Prior Publication Data

US 2022/0068573 A1 Mar. 3, 2022

(30) Foreign Application Priority Data

Jan. 18, 2019 (DE) ..... 10 2019 101 267.8

(51) Int. Cl.
*H01H 9/16* (2006.01)
*H01H 3/02* (2006.01)
(Continued)

(52) U.S. Cl.
CPC ..... *H01H 9/16* (2013.01); *H01H 3/022* (2013.01); *H01H 13/04* (2013.01); *H01H 13/14* (2013.01);
(Continued)

(58) Field of Classification Search
CPC ..... H01H 9/16; H01H 3/022; H01H 13/04; H01H 13/14; H01H 2003/024; H01H 2003/0246; H01H 13/12; H01H 3/02
See application file for complete search history.

(56) References Cited

U.S. PATENT DOCUMENTS 3,356,816 A 12/1967 Clarke
3,729,607 A 4/1973 Ellenberger
(Continued)

FOREIGN PATENT DOCUMENTS

CN 104701047 A 6/2015
EP 2413341 A1 2/2012
WO WO 0169619 A1 9/2001

OTHER PUBLICATIONS

Schlegel, *Produktkatalog: Faszination Elektrotechnik*, Schlegel Elektrokontakt, Dec. 2016, pp. 1, 390, 595, Georg Schlegel GmbH & Co. KG, Dürmentingen, Germany.

*Primary Examiner* — Lheiren Mae A Caroc
(74) *Attorney, Agent, or Firm* — LEYDIG, VOIT & MAYER, LTD.

(57) ABSTRACT

A push-button switch assembly with identification of switching states includes: a push-button switch having an actuating head for actuating the push-button switch and having a push-button guide; and an adapter device for attaching the push-button switch to a housing body. The adapter device fastens the push-button switch in a bore of the housing body. The adapter device compensates for a different diameter of the bore of the housing body and the push-button guide. The push-button guide has a plunger which is arranged in a hollow body of the push-button guide and movable in the hollow body of the push-button guide when the actuating head is actuated. By actuating the actuating head, the push-button switch is switchable from a non-released state to a released state. The push-button
(Continued)

switch is arranged such that a region thereof visibly protrudes from under the actuating head when the push-button switch is in the non-released state.

10 Claims, 6 Drawing Sheets

(51) Int. Cl.
*H01H 13/04* (2006.01)
*H01H 13/14* (2006.01)

(52) U.S. Cl.
CPC ..... *H01H 2003/024* (2013.01); *H01H 2003/0246* (2013.01)

(56) References Cited

U.S. PATENT DOCUMENTS

| | | | | |
|---|---|---|---|---|
| 5,408,061 | A | 4/1995 | Martin | |
| 8,492,668 | B2 * | 7/2013 | Broly | H01H 3/022 200/318.2 |
| 9,390,874 | B2 * | 7/2016 | Meftah | G08C 17/02 |
| 10,937,606 | B2 * | 3/2021 | Betsuda | H01H 13/7073 |
| 2015/0155111 | A1 | 6/2015 | Kondrus | |

* cited by examiner

PUSH-BUTTON SWITCH ASSEMBLY WITH IDENTIFICATION OF SWITCHING STATES

CROSS-REFERENCE TO PRIOR APPLICATIONS

This application is a U.S. National Phase application under 35 U.S.C. § 371 of International Application No. PCT/EP2020/050652, filed on Jan. 13, 2020, and claims benefit to German Patent Application No. DE 10 2019 101 267.8, filed on Jan. 18, 2019. The International Application was published in German on Jul. 23, 2020 as WO 2020/148210 under PCT Article 21(2).

FIELD

The invention relates to a push-button switch assembly in which different switching states are visibly indicated on the basis of the switch position.

BACKGROUND

In the case of a push-button switch assembly, a standard may stipulate that different states of a push-button switch of the assembly are clearly recognizable for an observer. The push-button switch assembly can be designed, for example, as an emergency stop switch with which one or more electrical contacts between two conductors can be separated.

Such a push-button switch assembly usually has different components which can be assembled according to a modular system. The components of a push-button switch assembly include, for example, a generally mushroom-shaped actuating head that is placed on a push-button guide. The push-button guide can be designed as a hollow body and has a plunger in its interior, which is arranged in the push-button guide to be movable by means of the actuating head.

The push-button switch assembly is mounted on a housing body having a contact element in the interior. The contact element can be designed, for example, as a switch for closing (N/O contact) or as a switch for opening (N/C contact) or as a combination of N/C contact and N/O contact. When the actuating head is actuated by an operator, for example, when the actuating head is pressed or turned, the plunger in the interior of the push-button guide is moved. The plunger acts on the contact element in the interior of the housing body, so that an electrical contact is separated if the contact element is designed as an N/C contact or closed if the contact element is designed as an N/O contact.

U.S. Pat. No. 3,729,607 A describes an overcurrent switch in which a push-button switch comprising an actuating head and a push-button guide is attached to a housing via an adapter. Colored bands are arranged on the push-button guide to identify switching states.

EP 2 413 341 describes a push-button having a display of switching states, wherein the display is arranged in an actuating head. The actuating head is movably arranged above a housing.

Further push-button switches which are attached to a housing via an adapter are described in U.S. Pat. Nos. 3,356,816 A and 5,408,061 A.

SUMMARY

In an embodiment, the present invention provides a push-button switch assembly with identification of switching states, comprising: a push-button switch having an actuating head configured to actuate the push-button switch and having a push-button guide; and an adapter device configured to attach the push-button switch to a housing body, wherein the adapter device is configured to fasten the push-button switch in a bore of the housing body, wherein the adapter device is configured to compensate for a different diameter of the bore of the housing body and the push-button guide, wherein the push-button guide has a plunger which is arranged in a hollow body of the push-button guide and movable in the hollow body of the push-button guide when the actuating head is actuated, wherein, by actuating the actuating head, the push-button switch is switchable from a non-released state to a released state, wherein the push-button switch is configured such that a region of the push-button guide visibly protrudes from under the actuating head when the push-button switch is in the non-released state, wherein the push-button switch is configured such that the region of the push-button guide is covered by the actuating head in a non-visible manner when the push-button switch is in the released state, and wherein, in the region of the push-button guide, the push-button guide has an integrally-colored material comprising a plastic, a color of which differs from a color of the actuating head and a color of the adapter device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
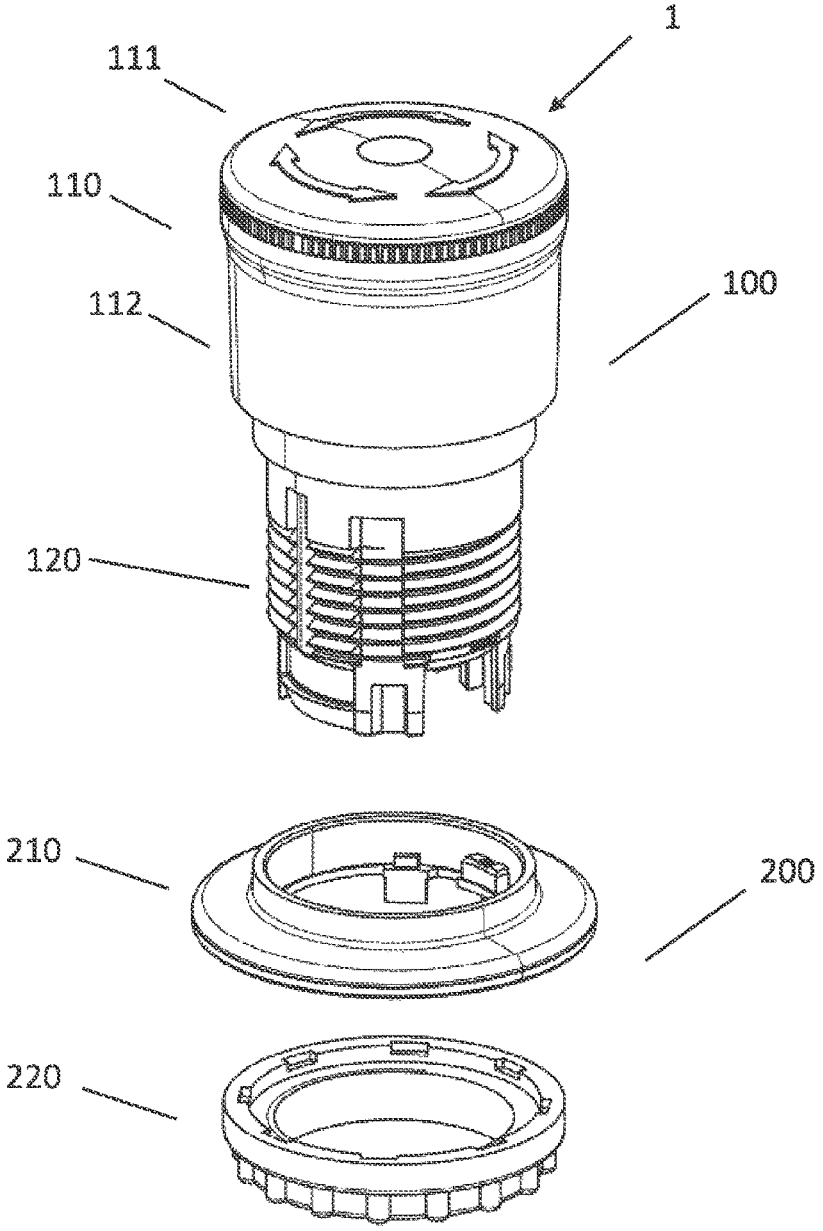
FIG. 1 shows an embodiment of a push-button switch assembly having a push-button switch and an adapter device.

In an embodiment, the present invention provides a push-button switch assembly in which different switching states are clearly recognizable for an operator, wherein the push-button switch assembly is flexible in use and can be manufactured at low production costs.

Such a push-button switch assembly with identification of switching states is specified herein.

The push-button switch assembly comprises a push-button switch having an actuating head for actuating the push-button switch and having a push-button guide. Furthermore, the push-button switch assembly comprises an adapter device for attaching the push-button switch to a housing body. The housing body can be provided for receiving a contact element. The contact element can be used to open and/or close an electrical contact. The push-button guide has an integrally-colored material consisting of a plastic, the color of which differs from a color of the actuating head and a color of the adapter device.

An integrally-colored plastic material refers to a plastic having a raw polymer with a colored granulate (color batch) added as an additive. The raw polymer is an uncolored plastic that is initially transparent, for example. The colored granulate is a plastic additive in the form of a granulate with a content of colorants. A previously uncolored or transparent plastic can thus consistently take on the color that is determined by the color additive. Alternatively, an integrally-colored plastic material can be produced by using a colored plastic. Subsequent painting of the colorless (transparent) plastic or subsequent gluing of a colored film onto a colorless plastic material in order to give the plastic material a color can thus be omitted.

According to a possible embodiment of the push-button switch assembly, the actuating head can have a mushroom-shaped upper part and a tubular lower part. The push-button guide can be arranged at least partially in the interior of the tubular lower part. When the push-button switch is actuated from an initial non-released state to a released state, the actuating head can be pressed or turned. In the released state of the push-button switch, the actuating head can be locked in its position using a locking mechanism. Such a mechanism is described in WO 01/69619 A1.

The actuating head can be moved from the released position back to the non-released position by pulling or turning. Any combination of pulling and turning movements is possible. The push-button switch can be switched to the released state, for example, by pressing the actuating head and then switched back to the non-released state by turning the actuating head.

The push-button switch is designed such that, in the non-released state of the push-button switch, a region of the push-button guide, in particular the integrally-colored material of the push-button guide, protrudes from under the actuating head and is thus visible when the push-button switch assembly is fastened to the main part. In the push-button switch assembly according to the invention, it is provided that, in the released state of the push-button switch, the push-button guide is covered by the actuating head such that the region of the push-button guide, in particular the integrally-colored material of the push-button guide, is no longer visible when the push-button switch assembly is fastened to the main part.

In order to be able to mount the push-button switch with the actuating head and the push-button guide as flexibly as possible on different housing bodies, the push-button switch assembly has the adapter device for attaching the push-button switch to the housing body in which the contact element is arranged. A further region of the push-button guide, which is arranged below the region of the push-button guide covered by the actuating head when the push-button switch is in the released state, is covered by the adapter device regardless of the state of the push-button switch. The interaction of the actuating head and the adapter device can ensure that the push-button guide, in particular the integrally-colored plastic material of the push-button guide, is covered in a completely non-visible manner when the push-button switch is in the released state.

The housing body can have a bore for inserting the push-button switch. The adapter device makes it possible for the same push-button switch to be used in housing bodies with different bores. The adapter device compensates for a difference between the outer diameter of the push-button guide and the inner diameter of the bore of the housing body.

The adapter device preferably has the same color as the housing body. In the non-released state of the push-button, an operator can see, in addition to the actuating head, the push-button guide, colored with a different color, under the actuating head and above the uniformly colored assembly of the housing body and the adapter device. If the push-button switch assembly is designed, for example, as an emergency stop switch, the actuating head is colored red, the push-button guide has an integrally-colored green plastic material, and the adapter device has a yellow-colored plastic material. The yellow coloration can correspond to a yellow coloration of the housing body.

When the actuating head is actuated, for example, by pressing the actuating head in the axial direction or by turning the actuating head, the lower part of the actuating head covers the region of the integrally-colored push-button guide that was previously visible in the non-released state, so that the green color of the push-button guide is no longer visible to an operator. The two-color design consisting of the red-colored actuating head and the yellow-colored assembly of the housing body and the adapter device visually signals to an operator that the push-button switch has been released.

In addition to the push-button guide or the adapter device, the actuating head can also be made from an integrally-colored plastic material.

By using an integrally-colored plastic material for the different components, in particular for the push-button guide, additional processing steps, for example, subsequent imprinting of the push-button guide, in the case of an emergency stop switch with a green color, or the covering of the push-button guide with a colored film, for example, with a green film, can be omitted.

FIG. 1 shows an embodiment of a push-button switch assembly 1 according to the invention with identification of switching states. The push-button switch assembly has a push-button switch 100. The push-button switch 100 comprises an actuating head 110 for actuating the push-button switch and a push-button guide 120. The actuating head 110 has an upper part 111 and a lower part 112. The lower part 112 is designed as a cylindrical or tubular hollow body. The push-button guide 120 is at least partially arranged in the hollow body of the lower part 112 of the actuating head 110. Furthermore, the push-button switch assembly 1 comprises an adapter device 200 for attaching the push-button switch 100 to a housing body for receiving a contact element for opening and/or closing an electrical contact.

The push-button guide 120 has an integrally-colored material, in particular an integrally-colored plastic, the color of which differs from a color of the actuating head 110 and a color of the adapter device 200.

Figure 2A:
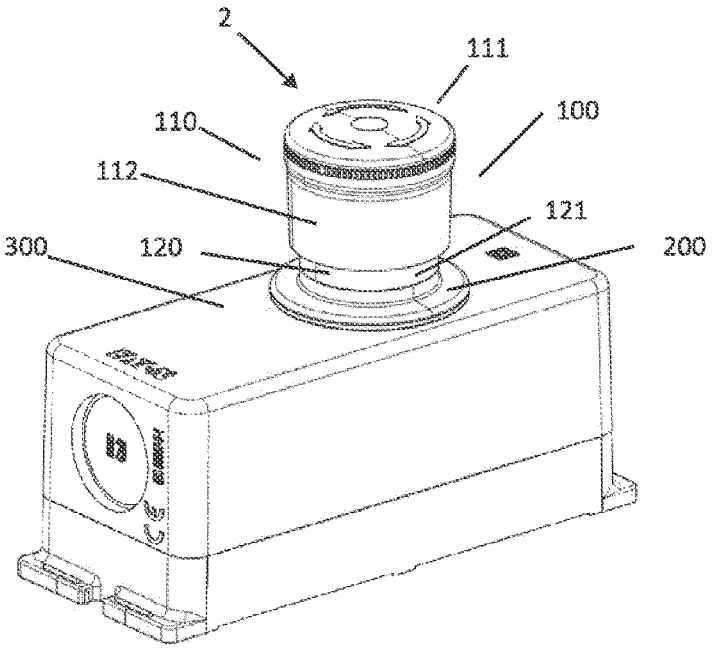
FIG. 2A is a perspective view of a device having a push-button switch assembly and a housing body for receiving a contact element in the non-released state.
Figure 2B:
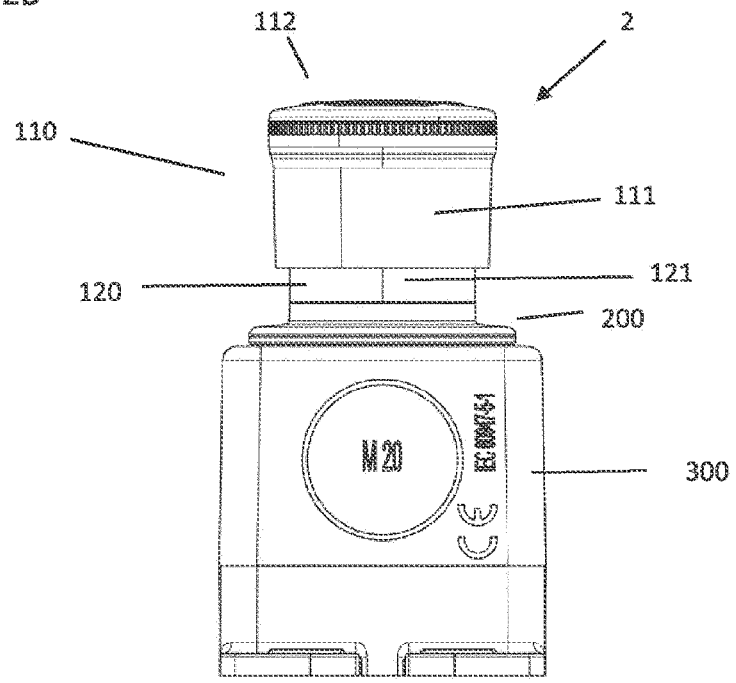
FIG. 2B is a cross-sectional view of a device having a push-button switch assembly and a housing body for receiving a contact element in the non-released state.
Figure 3A:
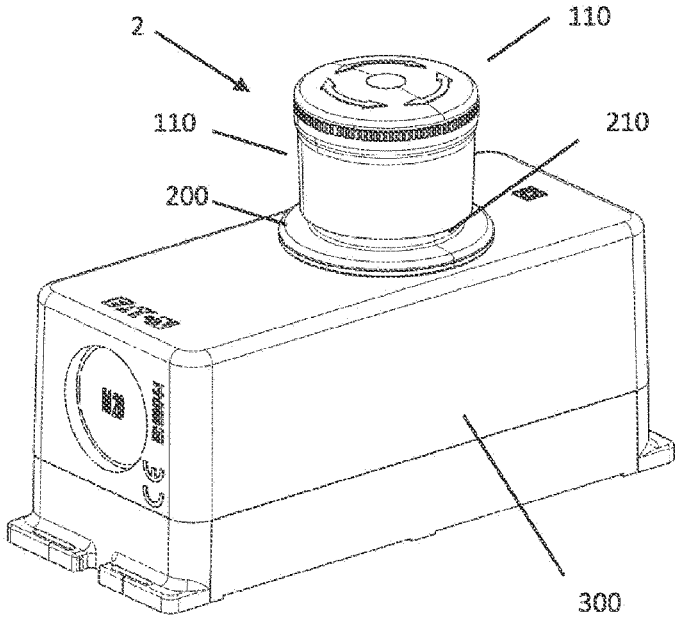
FIG. 3A is a perspective view of a device having a push-button switch assembly and a housing body for receiving a contact element in the released state.
Figure 3B:
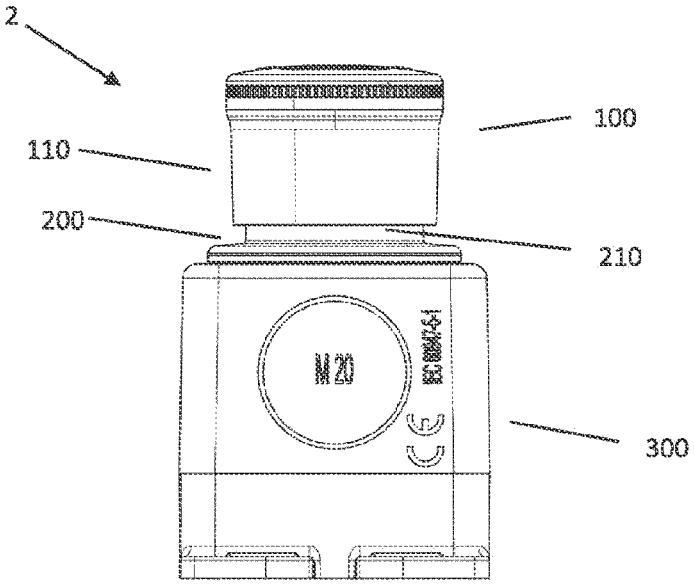
FIG. 3B is a cross-sectional view of a device having a push-button switch assembly and a housing body for receiving a contact element in the released state.

FIGS. 2A and 3A each are a perspective view of a device 2 having the push-button switch assembly 1 and a housing body 300 on which the push-button switch 100 is mounted by means of the adapter device 200. FIG. 2B is a cross-sectional view of the perspective view of the device 2 from FIG. 2A in the non-released state. FIG. 3B is a cross-sectional view of the perspective view of the device 2 from FIG. 3A in the released state.

A contact element is located in the interior of the housing body 300, which is designed, for example, as a switch for opening (N/C contact) or as a switch for closing (N/O contact) an electrical contact. By actuating the actuating head 110, the push-button switch 100 can be switched from the non-released state to the released state.

According to one possible embodiment, the push-button switch 100 can be designed such that, in the released state of the push-button switch, an electrical contact between two conductors in the contact element can be separated if the contact element is designed as an N/C contact and the push-button switch assembly 1 is attached to the housing body 300. In this case, the electrical contact between the two conductors is closed in the non-released state of the push-button switch 100.

According to a further possible embodiment, the push-button switch 100 can be designed such that, in the released state of the push-button switch, an electrical contact between two conductors in the contact element can be closed if the contact element 400 is designed as an N/O contact and the push-button switch assembly 1 is attached to the housing body 300. In such an embodiment, the electrical contact between the two conductors is separated in the non-released state of the push-button switch 100.

According to the two embodiments mentioned above, the push-button switch assembly can be designed as an emergency stop button/switch. The emergency stop button/switch is a switching element on machines, vehicles and systems. It is used to quickly put them in a safe state in the event of danger or to avert danger. If released, the power supply is interrupted. However, other embodiments are also possible in which the push-button switch assembly is designed, for example, as a stop switch. The stop switch is suitable for switching off a machine or a system.

The push-button guide 120 is designed as a tubular hollow body. A plunger (not depicted) can be arranged in the hollow body of the push-button guide 120, which is moved in the hollow body of the push-button guide 120 when the actuating head 110 is actuated, in particular when the actuating head 110 is pressed or turned. The plunger acts on the contact element 400 in the interior of the housing body 300 such that the electrical contact between the conductors is separated or closed depending on the design of the contact element as an N/C contact or an N/O contact.

As is apparent from FIGS. 2A and 2B, the push-button switch 100 is designed such that, in the non-released state of the push-button switch 100, a region 121 of the push-button guide 120, in particular a region 121 of the integrally-colored material of the push-button guide 120, visibly protrudes from under the actuating head 110 when the push-button switch assembly 1 is attached to the main part 300. According to the embodiment of the push-button switch assembly shown in FIGS. 2A and 2B, the push-button guide 120 is partially arranged in the hollow body of the lower part 112 of the actuating head 110 when the push-button switch 100 is in the non-released state and the region 121 of the push-button guide 120, in particular the integrally-colored plastic material of the push-button guide 120, visibly protrudes from the hollow body of the lower part 112 of the actuating head 110 when the push-button switch assembly 1 is attached to the main part 300.

As is apparent from FIGS. 3A and 3B, the push-button switch 100 is furthermore designed such that, in the released state of the push-button switch, the region 121 of the push-button guide 120 is covered in a non-visible manner by the actuating head 110 when the push-button switch assembly 1 is attached to the main part 300. The region 121 of the push-button guide 120 is thus arranged completely in the hollow body of the lower part 112 of the actuating head 110 when the push-button switch 100 is in the released state. As a result, the region 121 of the push-button guide 120, in particular the integrally-colored plastic material of the push-button guide 120, is directly covered by the lower part 112 of the actuating head 110.

Figure 4:
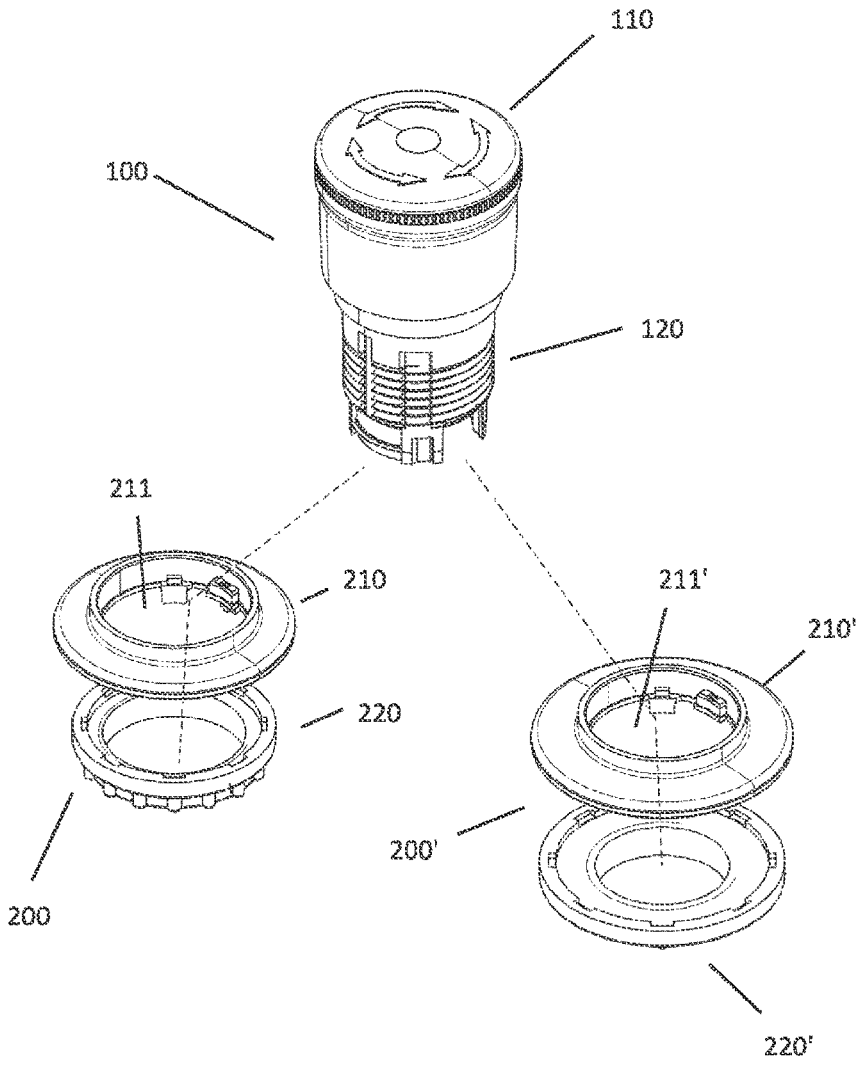
FIG. 4 shows embodiments of a push-button switch assembly having different adapter devices for flexible attaching of a push-button switch on a housing body for receiving a contact element.
Figure 5A:
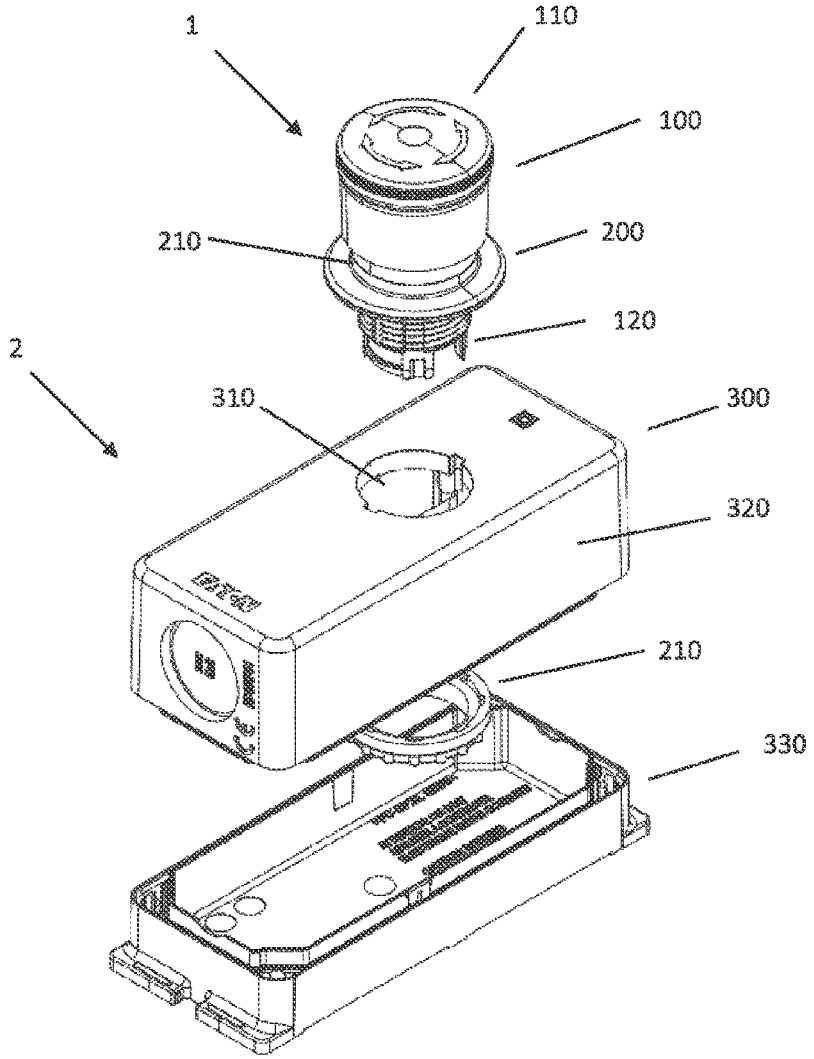
FIG. 5A is a perspective view of a device having a push-button switch assembly and a first embodiment of a housing body for receiving a contact element.
Figure 5B:
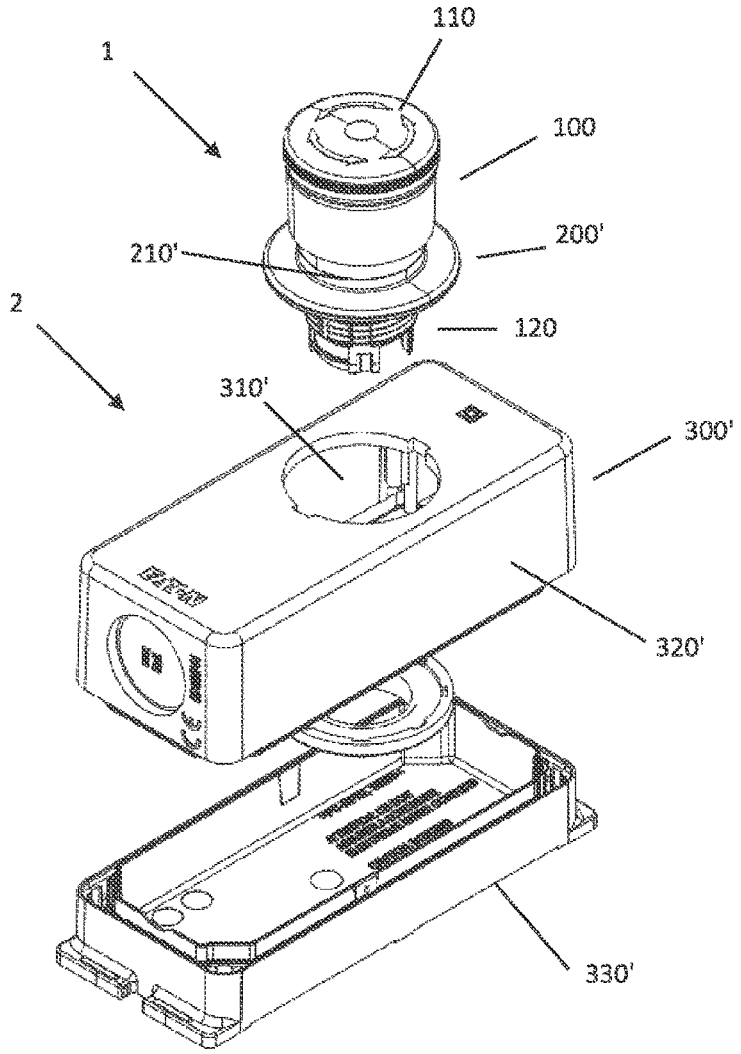
FIG. 5B is a perspective view of a device having a push-button switch assembly and a second embodiment of a housing body for receiving a contact element.

FIG. 4 shows the push-button switch assembly 1 comprising the push-button switch 100 and two different adapter devices 200 and 200'. It should be noted that the push-button switch assembly can also have further adapter devices. FIG. 5A shows an embodiment of the device 2 having the push-button switch 100 and the adapter device 200 for attaching the push-button switch 100 on a housing body 300. The housing body 300 can have an upper housing part 320 and a lower housing part 330. FIG. 5B shows an embodiment of a device 2 having the push-button switch 100 and the adapter device 200' for attaching the push-button switch 100 on a housing body 300' different from the housing body 300. The housing body 300' can have an upper housing part 320' and a lower housing part 330'.

The adapter device 200 is designed to fasten the push-button switch 100 in a bore 310 of the housing body 300. For this purpose, the adapter device 200 has an adapter ring 210 which is designed to compensate for a different diameter of the bore 310 of the housing body 300 and the push-button guide 120. As is apparent from FIG. 5A, the adapter ring 210 can be inserted into the bore 310 of the housing body 300. The adapter ring 210 has a hole 211 for receiving the push-button guide 120. The adapter device 200 further comprises a counter nut 220 for attaching the push-button switch 100 to the housing body 300. The counter nut 220 prevents the push-button switch 100 from being rotated at will in the borehole 310.

The further adapter device 200' can be used to fasten the push-button switch 100 to the housing body 300', as shown in FIG. 5B. The further adapter device 200' is designed in particular to fasten the push-button switch 100 in a bore 310' of the housing body 300'. The diameter of the bore 310' of the housing body 300' differs from the diameter of the bore 310 of the housing body 300. The further adapter device 300' is thus designed to compensate for a different diameter of the bore 310' of the housing body 300' and the push-button guide 120.

The adapter ring 210, 210' has a material consisting of an integrally-colored plastic, the color of which differs from the color of the actuating head 110 and the color of the push-button guide 120. The adapter ring 210, 210' can preferably have the same color as the housing body 300, 300'. Different colorations are possible depending on the application.

By means of the different adapter devices, it is possible to attach the same push-button switch 100 to different housing bodies 300, 300', in particular housing bodies with different borehole sizes. It is therefore not necessary to provide a push-button switch specifically manufactured for each housing body with a different bore. Instead, only another adapter device is required. With the described push-button switch assembly, the assembly of the push-button switch can be flexibly adapted to housing bodies with different borehole sizes for receiving the push-button switch assembly by using the adapter device.

Furthermore, with the use of integrally-colored plastic materials, the production costs for the push-button switch assembly are significantly reduced when compared to an embodiment in which, for example, a colored ring is printed on or a colored film is glued onto an uncolored plastic material.

In the assembled state of the device 2, a region of the integrally-colored plastic material of the push-button guide 120, which is arranged below the region 121 of the push-button guide, is covered by the adapter ring 210, 210' regardless of the released or non-released position of the push-button switch. In the released state of the push-button switch, the region 121 is covered by the lower part 112 of the actuating head in a non-visible manner. Since the adapter ring 210, 210' also covers a portion of the push-button guide 120 above the housing body 300, the integrally-colored plastic material of the push-button guide 120 is covered in a non-visible manner when the push-button is in the released state. However, in the non-released state of the push-button switch, the region 121 of the push-button guide is visible. The switching state of the push-button switch can thus be easily recognized by an operator.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Push-button switch assembly
2 Device having push-button switch assembly and housing body
100 Push-button switch
110 Actuating head
111 Lower part
112 Upper part
120 Push-button guide
121 Region of the push-button guide
200, 200' Adapter device
210, 210' Adapter ring
220, 220' Counter nut
211, 211' Hole for receiving the push-button guide
300, 300' Housing body
310, 310' Bore
320, 320' Upper housing part
330, 330' Lower housing part

The invention claimed is:

1. A push-button switch assembly with identification of switching states, comprising:

a push-button switch having an actuating head configured to actuate the push-button switch and having a push-button guide; and an adapter device configured to attach the push-button switch to a housing body, wherein the adapter device is configured to fasten the push-button switch in a bore of the housing body, wherein the adapter device is configured to compensate for a different diameter of the bore of the housing body and the push-button guide, wherein the push-button guide has a plunger which is arranged in a hollow body of the push-button guide and movable in the hollow body of the push-button guide when the actuating head is actuated, wherein, by actuating the actuating head, the push-button switch is switchable from a non-released state to a released state, wherein the push-button switch is configured such that a region of the push-button guide visibly protrudes from under the actuating head when the push-button switch is in the non-released state, wherein the push-button switch is configured such that the region of the push-button guide is covered by the actuating head in a non-visible manner when the push-button switch is in the released state, and wherein, in the region of the push-button guide, the push-button guide has an integrally-colored material comprising a plastic, a color of which differs from a color of the actuating head and a color of the adapter device.

2. The push-button switch assembly of claim 1, wherein the actuating head has an upper part and a lower part, wherein the lower part comprises a cylindrical hollow body, and wherein the push-button guide is arranged at least partially in the hollow body of the lower part of the actuating head.

3. The push-button switch assembly of claim 2, wherein the region of the push-button guide protrudes visibly from the hollow body of the lower part of the actuating head when the push-button switch is in the non-released state.

4. The push-button switch assembly of claim 3, wherein the region of the push-button guide is covered by the lower part of the actuating head.

5. The push-button switch assembly of claim 1, wherein the adapter device comprises an adapter ring.

6. The push-button switch assembly of claim 5, wherein the adapter ring comprises an integrally-colored plastic material, a color of which differs from the color of the actuating head and the color of the push-button guide.

7. The push-button switch assembly of claim 5, wherein a further region of the push-button guide, which is arranged below the region of the push-button guide, is covered by the adapter ring.

8. The push-button switch assembly of claim 1, further comprising:

a further adapter device configured to fasten the push-button switch in a bore of another housing body, wherein a diameter of the bore of the other housing body differs from a diameter of the bore of the housing body.

9. The push-button switch assembly of claim 1, wherein the push-button switch assembly comprises an emergency stop switch or a stop switch.

10. A device, comprising:

the push-button switch assembly of claim 1; and a housing body with the push-button switch assembly attached thereto.

* * * * *